United States Patent [19]

Smith

[11] 4,175,666

[45] Nov. 27, 1979

[54] TANK SUPPORT ASSEMBLIES

[75] Inventor: Robert G. Smith, Chesterfield, Mo.

[73] Assignee: Kleen-Rite, Inc., St. Louis, Mo.

[21] Appl. No.: 893,017

[22] Filed: Apr. 3, 1978

[51] Int. Cl.[2] ..... A47F 5/00

[52] U.S. Cl. ..... 211/71; 211/13; 211/182; 211/189; 248/150; 403/374

[58] Field of Search ..... 211/71, 13, 189, 182, 211/190, 191, 183, 186; 248/146, 150, 151, 127, 165, DIG. 7, 188.8; 403/374, 358, 409

[56] References Cited

U.S. PATENT DOCUMENTS

| | | | |
|---|---|---|---|
| 487,765 | 12/1892 | Ormerod | 211/71 |
| 840,696 | 1/1907 | Heberling | 211/71 X |
| 1,732,829 | 10/1929 | Boardman | 211/71 X |
| 2,746,703 | 5/1956 | Emery | 248/150 |
| 2,833,421 | 5/1958 | Skubic | 211/182 X |
| 2,846,078 | 8/1958 | Shelby | 248/DIG. 7 |
| 2,903,220 | 9/1959 | Pastor | 248/150 |
| 3,013,757 | 12/1961 | Brammer | 248/150 |
| 4,088,229 | 5/1978 | Jacoby et al. | 211/191 |

*Primary Examiner*—Roy D. Frazier
*Assistant Examiner*—Robert W. Gibson, Jr.
*Attorney, Agent, or Firm*—Richard J. Sher

[57] ABSTRACT

A minimum number of economical component parts may easily be assembled at the location of installation to form a tank support assembly which will hold one, two, three or more tanks in a stable and safe manner. The assembly is comprised of a pair of base members, each including a pair of upwardly directed sockets. A vertical post member is inserted into and held within each socket, and flexible support straps are hung between opposed hanger brackets which are affixed to each post member. The tank or tanks are then held in place between the post members on a longitudinally-spaced pair of support straps. The number of tanks which can be supported by the assembly is determined only by the height of the post members and the number of hanger brackets thereon.

8 Claims, 8 Drawing Figures

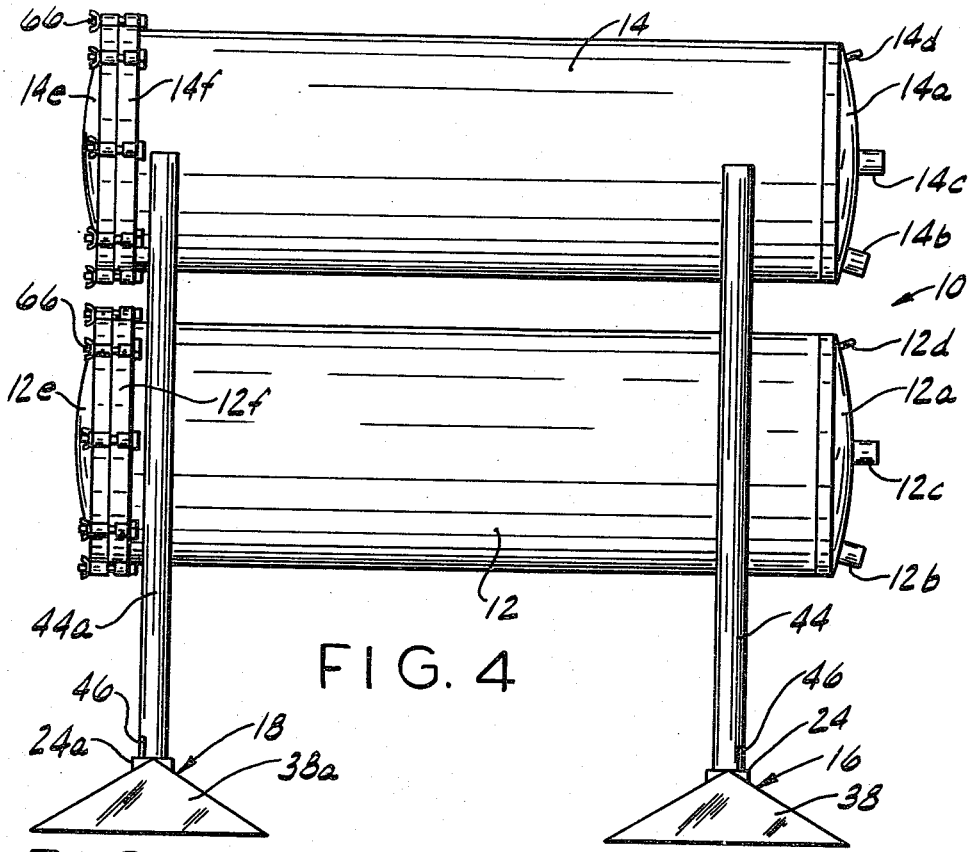
FIG. 4
FIG. 6
FIG. 5
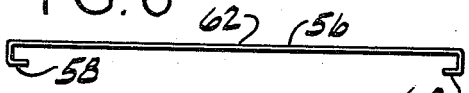
FIG. 7
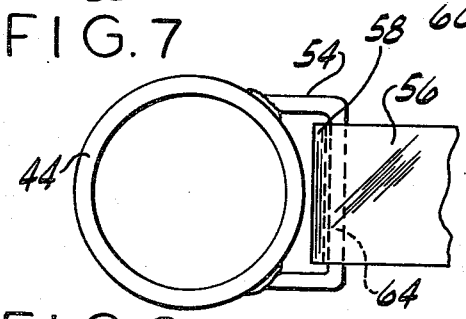
FIG. 8
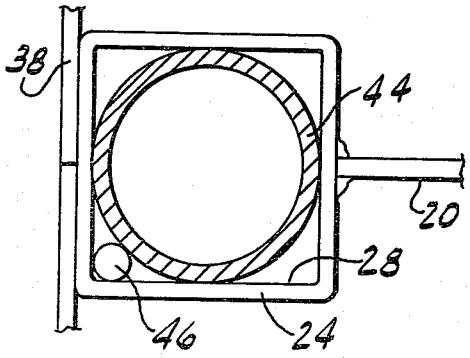
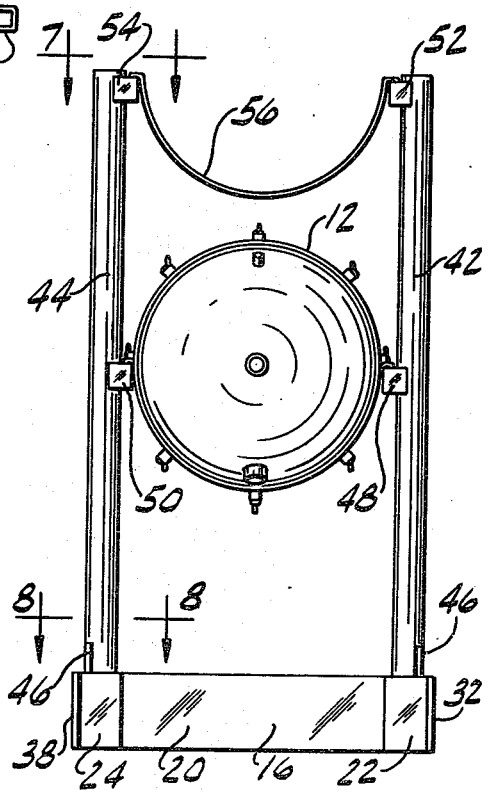

TANK SUPPORT ASSEMBLIES

BACKGROUND AND SUMMARY OF THE INVENTION

The present invention relates to tank support assemblies which may be shipped to the location of installation in disassembled, component form and then assembled on location by unskilled personnel with only a hammer.

Prior art tank supports have been complicated in design and extremely difficult to assemble at the location of installation. For example, filter tanks utilized in drycleaning establishments to filter drycleaning fluid have heretofore been rigidly affixed to heavy, bulky support assemblies which require a great deal of fasteners and welding. The tanks are then shipped already assembled on the supporting structure in large crates. A distributor of such tanks in the past would be required to maintain a vast inventory of complete tank assemblies in order to readily satisfy customer demands for tank systems having one, two, three or more tanks. The cost of shipping such prefabricated tank systems has also been great.

Other tank supports such as that shown in U.S. Pat. No. 2,903,220 to Pastor are limited to supporting a single tank and are again complicated in construction.

Tank support assemblies manufactured according to the principles of the invention may be shipped to the ultimate user in disassembled components which are each inexpensive yet strong and durable in construction. A minimum number of different component parts are needed to assemble support structures which can accomodate one, two, three or more vertically juxtaposed tanks. This fact permits a great reduction in the inventory required to be maintained by a distributor of the assemblies. Further, the assembler need not be skilled: only a hammer is required to complete the assembly.

According to the invention, a pair of identical, elongated base members, each including a pair of longitudinally-spaced, upwardly-directed sockets are placed on the floor in spaced, parallel relationship. A vertical post member is inserted and held within each socket and flexible support straps are hung between opposed hanger brackets which are affixed to each post member. Each cylindrical post member is secured within the square socket by a solid metal pin hammered into a corner of each socket. By varying only the height of the post members and the number of hanger brackets thereon, the support assembly may be formed to securely support one, two, three or more vertically juxtaposed tanks. A distributor need only carry an inventory of base members, support straps, pins and a variety of post member lengths in order to ensure the prompt delivery of any of a variety of tank support structures.

Therefore, the primary object of the invention is to provide a strong and stable tank support assembly formed from a minimum number of novel component parts, each being inexpensive in fabrication.

It is a further object to provide tank assemblies which will safely and durably support one or a plurality of elongated tanks.

It is still a further object of the invention to provide assemblies which are extremely economical in distribution and facile in assembly.

These as well as other objects and advantages of the invention will become more apparent upon a reading of the hereinbelow described preferred embodiment of the invention in conjunction with the drawings wherein:

FIG. 4 is a side elevational view of the assembly;

FIG. 5 is a front elevational view with the upper tank of the assembly removed for the purpose of clarity of description;

FIG. 6 is a front elevational view of a tank support strap prior to assembly;

FIG. 7 is an enlarged view taken along line 7—7 of FIG. 5; and

FIG. 8 is an enlarged cross-sectional view taken along line 8—8 of FIG. 5.

DETAILED DESCRIPTION OF THE PREFERRED EMBODIMENT

Figure 1:
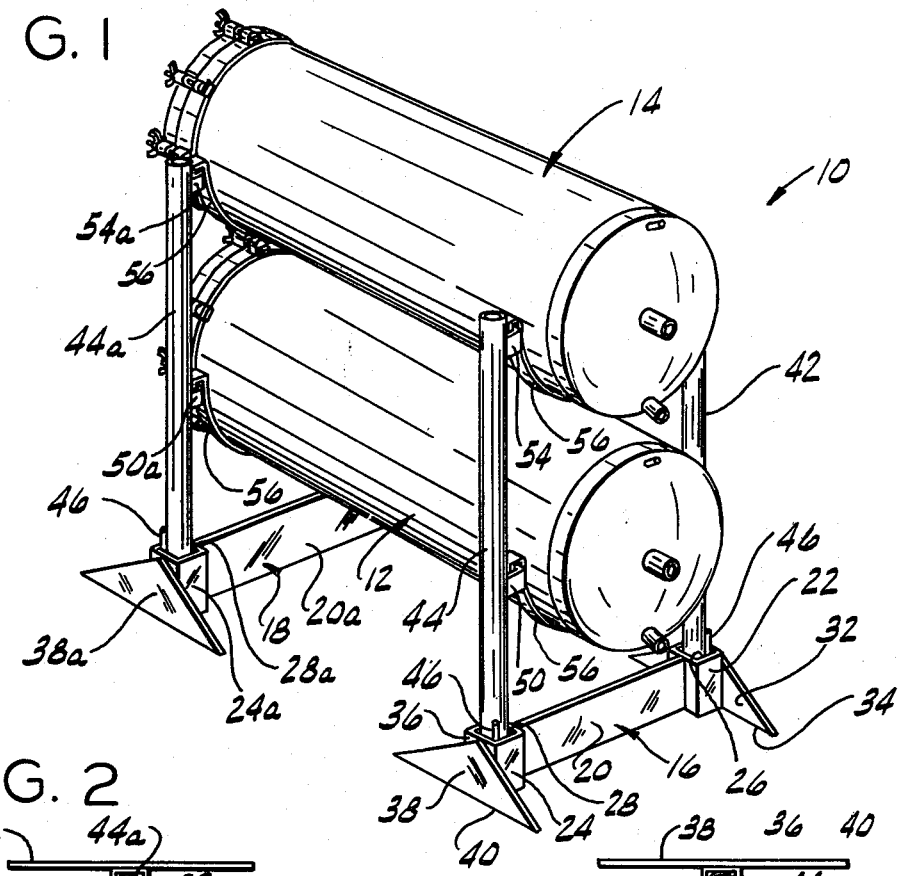
FIG. 1 is a perspective view of a tank support assembly constructed according to the principles of the invention and showing an embodiment of the invention supporting two tanks.
Figure 2:
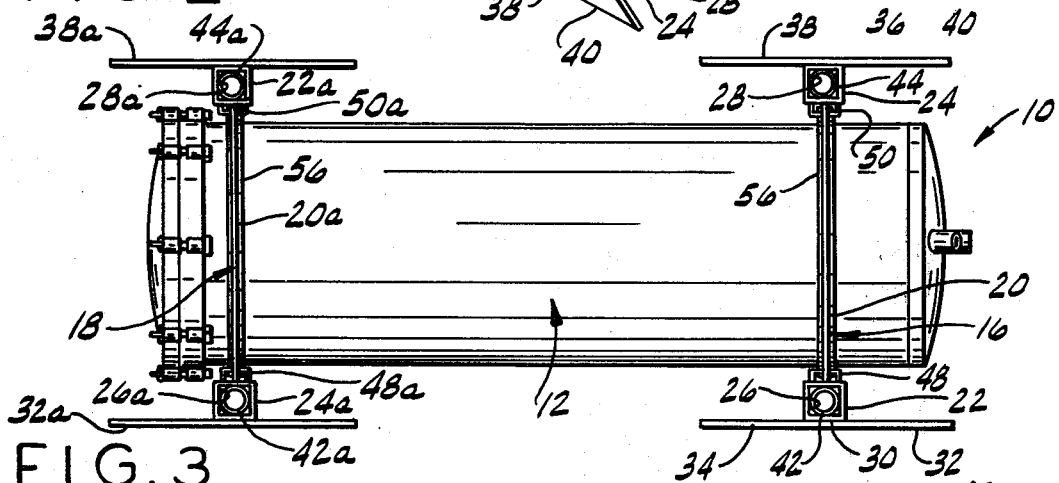
FIG. 2 is a bottom plan view of the assembly shown in FIG. 1.
Figure 3:
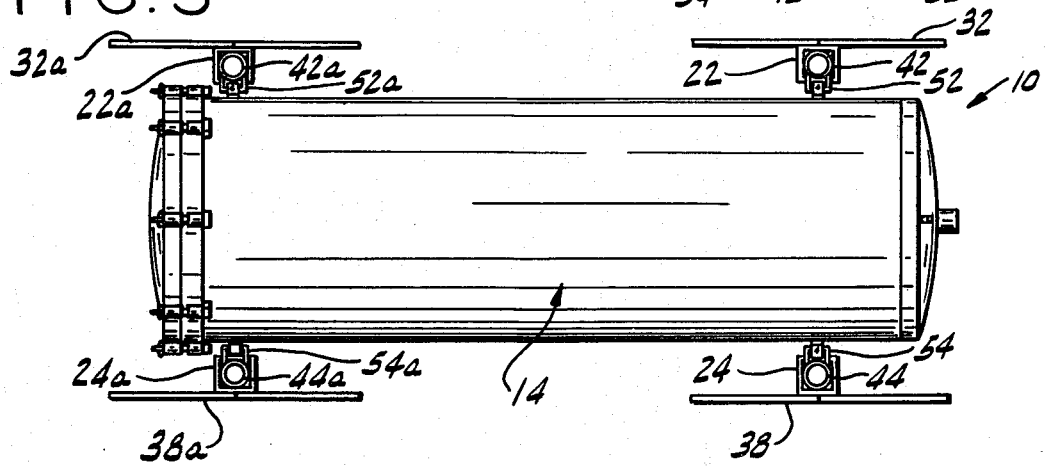
FIG. 3 is a top plan view of the assembly shown in FIG. 1.

With reference to the drawings and to FIG. 1 in particular, there is shown a tank support assembly, generally indicated by the numeral 10, constructed in accordance with the teachings of the present invention. Tank support assembly 10 supports a lower, elongated, generally-cylindrical tank 12 and an upper, elongated, generally-cylindrical tank 14; tanks 12 and 14 being held in a parallel axial relationship. It is noted at the outset that the novel component construction of the invention permits it to be utilized to support one, two, three or more vertically juxtaposed tanks with only minor changes of component parts, and for purposes of this description only, assembly 10 is shown in the drawings carrying two tanks.

Tank support assembly 10 includes a first elongated base member 16 and a second elongated base member 18 spaced from and parallel to base member 16. Base member 16 is fabricated of a central metal plate member 20 situated in a vertical plane and having affixed to each end thereof as by welding, tubular metal members 22 and 24; each tubular member 22 and 24 being square in the horizontal cross-section and each forming a hollow, square socket therewithin 26 and 28, respectively, opening upwardly. Affixed to the outer end surface 30 of tubular member 22, as by welding, is an upstanding end plate member 32 of a triangular configuration and having the elongated base 34 thereof projecting in a direction perpendicular to the longitudinal axis of central plate member 16. Affixed to the outer end surface 36 of tubular metal member 24 is an upstanding, triangular end plate member 38, identical to plate member 32 and having the elongated base 40 thereof situated parallel to base 34 of plate member 32. Base member 16 is fabricated so that the bottom edges of central plate member 16 and tubular members 22 and 24 lie in the same plane with base edges 34 and 40 of end plate members 32 and 38, respectively; therefore, base member 16 will act as a stable supporting member when placed on a flat floor surface.

Base member 18 is constructed identically with base member 16 and includes an upstanding central plate member **20*a*; a pair of square, tubular members 22*a* and 24*a*, affixed to each end of central plate member 20*a*; and triangular upstanding end plate members 32*a*** and 38*a*, affixed to the outer end surfaces of tubular members 22*a* and 24*a*, respectively. Tubular members 22*a* and 24*a* are also square in horizontal cross-section and are hollow to define square, upwardly-directed sockets 26*a* and 28*a*, respectively.

Within sockets 26 and 28 of base member 16, there are positioned vertical post members 42 and 44, respectively; each of the post members 42 and 44 being cylindrical and fabricated from metal tubular stock material. Post members 42*a* and 44*a*, which are shown as being received within sockets 26*a* and 28*a*, respectively, of base member 18, are likewise formed from cylindrical, metal tubular stock material. Each of the sockets 26, 28, 26*a*, and 28*a* formed by tubular members 22, 24, 22*a* and 24*a*, respectively, has an internal side dimension slightly greater than the outside diameter of post members 42, 44, 42*a* and 44*a*. Therefore, each of the post members may be easily, yet snugly, received within the respective socket thereof. In order to prevent the withdrawal of a post member from the socket and to further stabilize the post member within the respective socket, a solid, cylindrical metal pin 46 of a relatively small diameter, and which may be slightly tapered, is inserted into one corner of each socket and is driven therein as by hammering (See FIG. 8). The introduction of pin 46 into the socket has been found to produce an extremely firm connection between the sockets and the respective post members inserted therein; and the slight deformation of the post member within the respective socket thereof caused by the insertion of pin 46 precludes the withdrawal of the post member and eliminates any wobbling of the post member within the socket which may have been initially experienced prior to the insertion of pin 46.

Post members 42 and 44 are each provided with lower hanger brackets 48 and 50, respectively, and upper hanger brackets 52 and 54, respectively. Each of the hanger brackets 48, 50, 52 and 54 is formed of a U-shaped metal member having each free end thereof welded to the surface of the respective post member thereof, thereby forming a vertical cavity therebetween (see FIG. 7). Hanger bracket 48 is situated directly beneath bracket 52, and bracket 50 is situated directly beneath bracket 54. Post members 42*a* 44*a* likewise carry lower hanger brackets 48*a* and 50*a* respectively; and upper hanger brackets 52*a* and 54*a*, respectively. Again, hanger bracket 48*a* is directly beneath bracket 52*a* and hanger bracket 50*a* is situated directly beneath bracket 54*a*. The vertical distance between the hanger brackets located on common post members is equal in all cases and is determined by the size and desired vertical spacing of the tanks to be supported.

A flexible metal hanger strap 56 is suspended between hanger brackets 52 and 54, between brackets 48 and 50, between brackets 52*a* and 54*a*, and between brackets 48*a* and 50*a*. As best seen in FIG. 6, each support strap 56 is formed of a band of flexible metal having at each end thereof, a downwardly and inwardly hooked arm portion 58 and 60. While the major central body portion 62 of strap 56 will easily flex, arm portions 58 and 60 are machine-formed to retain the hooked configuration thereof. As best seen in FIG. 7, the width of strap 56 is slightly less than the length of central member 64 of U-shaped bracket 54; and, therefore, arm portion 58 or 60 of strap 56 may easily be inserted downwardly into the cavity defined by each of the hanger brackets and a joined post member. The length of central body portion 62 of strap 56 is chosen so that when arm portions 58 and 60 are in place within a respective hanger bracket pair, for example bracket pair 52, 54 best seen in FIG. 5, body portion 62 will flex to form a generally hemispherical configuration of a radius equal to that of the tank to be supported. It should be noted, however, that straps 56 could be formed in any configuration conducive of snug support for tanks of a different shape.

While the tanks 12 and 14 do not per se form a part of the invention, the preferred embodiment of tanks 12 and 14 each contain longitudinally stacked filter cartridges (not shown) for filtering dry-cleaning fluid and the like. As shown in FIG. 4, tanks 12 and 14 include convex, permanently-affixed rear end caps 12*a* and 14*a*, respectively, each being fitted with lower, internally-threaded, inlet connectors 12*b* and 14*b*, respectively; central, internally-threaded outlet connectors 12*c* and 14*c*, respectively; and upper, internally-threaded, air bleed connectors 12*d* and 14*d*, respectively. Tanks 12 and 14 also include convex front end caps 12*e* and 14*e*, respectively; which are removably attached to a respective tank by annular collars 12*f* and 14*f*, respectively, affixed to the respective tank and carrying a series of circumferentially-spaced wing-nut connectors 66.

In the case of the tanks 12 and 14 described hereinabove, it is preferable to locate hanger brackets 48*a* and 50*a* at a vertical height slighly above that of brackets 48 and 50, and hanger brackets 52*a* and 54*a* should be slightly above brackets 52 and 54. In this manner, liquid in tanks 12 and 14 will readily drain through inlet connectors 12*b* and 14*b* when the end caps 12*e* and 14*e* are to be removed to change the filter cartridges therein.

When it is desired to assemble a tank support assembly 10 in, for example, a drycleaning establishment, the number of tanks needed is calculated; then the length of post members 42, 44, 42*a* and 44*a* and the number of hanger brackets on each is determined. For example, if only one tank is to be installed, post members of only approximately half the height of those shown in the drawings need be utilized, each having only one hanger bracket thereon. If three or more tanks are to be installed, then it is clear that longer post members than those shown will be needed, having an increased number of hanger brackets on each: one hanger bracket for each tank to be supported. In any case, base members 16 and 18, straps 56 and pins 46 will be the same as shown in the drawings no matter how many tanks are to be utilized.

In assembling the embodiment shown in the drawings, base members 16 and 18 are first placed on the floor parallel to each other and spaced at a distance just short of the length of the tanks 12 and 14. Post member 42 is then placed in socket 26 and post member 44 is placed in socket 28 of base member 16. Post member 42*a* is inserted into socket 26*a* and post member 44*a* is placed into socket 28*a* of base member 18. Post members 42 and 44 are turned so that the respective hanger brackets thereof, 48, 52 and 50, 54 are facing toward each other; and post members 42*a* and 44*a* are turned so that the respective hanger brackets thereof, 48*a*, 52*a* and 50*a*, 54*a*, are also facing. Thereafter, support straps 56 are hung between lower hanger bracket pairs 48, 50 and 48*a*, 50*a*; and tank 12 is then positioned across these support straps. Additional support straps 56 are hung between upper hanger bracket pairs 52, 54 and 52*a*, 54*a*, and then tank 14 is located across the latter-mentioned support straps. Pins 46 are then driven into a corner of each of sockets 26, 28, 26*a* and 28*a* to eliminate any tendency for the post members to wobble.

It can readily be appreciated that a distributor of tank support assemblies, made according to the invention, need only maintain an inventory of tanks 12, 14; base members 16, 18; support straps 56; pins 46 and post members 42, 44, 42*a*, 44*a* of various standard heights; in order to be able to supply assemblies capable of supporting one, two, three or more tanks. The possibility of maintaining an inventory of so few elements to produce various tank assembly sizes, coupled with the fact that each component is inexpensive and easy to assemble, creates a significant savings for the distributor and for the customer.

It is therefore seen that the novel component construction described hereinabove produces an extremely economical tank support assembly, capable of supporting one, two, three or more tanks; each assembly requires a minimum of labor time and equipment for installation; the shipping volume is reduced; and the assembly may be readily dismantled and relocated if desired. The assembly is strong and stable and requires virtually no maintenance. Therefore, the objects of the invention first mentioned hereinabove are fulfilled by the construction described.

Inasmuch as numerous modifications may be made to the construction of the preferred embodiment without departing from the spirit or scope of the invention, it is requested that the scope of the invention be determined solely by the claims appended hereto.

I claim:

1. A tank support assembly comprising:

a first elongated base member adapted to rest upon a floor surface;

a second elongated base member adapted to rest upon such floor surface and being spaced from and parallel to said first base member;

said first and second base members each including, adjacent each end thereof, socket means which are vertically oriented in a stable manner a first and second vertical post member supported within respective ones of said socket means of said first base member;

a third and fourth vertical post member supported within respective ones of said socket means of said second base member;

at least one hanger bracket on each of said post members;

a first tank support member carried by and between said hanger brackets on said first and second post members, and a second tank support member carried by and between said hanger brackets on said third and fourth post members; and an elongated tank supported on said first and second tank support members.

2. A tank support assembly as specified in claim 1 and further characterized by:

each of said socket means being comprised by a vertically disposed tubular member being square in horizontal cross-section and each of said post members being fabricated of tubular stock material having a circular horizontal cross-section; and the outside diameter of each of said post members being slightly smaller than the inside side dimension of each of said socket means.

3. A tank support assembly as specified in claim 2 and further characterized by:

A metal pin being driven into a corner of each of said socket means in order to fixedly secure said post members within a respective one of said socket means.

4. A tank support assembly as specified in claim 1 and further characterized by:

each of said base members being comprised of a central metal plate member situated in a vertical plane, an upstanding tubular metal member affixed on each end of said central plate member, said tubular members forming said socket means; and an upstanding end plate member affixed to each outer side of a respective tubular member and being disposed in a vertical plane perpendicular to the plane of said central plate member.

5. A tank support assembly as specified in claim 1 and further characterized by:

each of said hanger brackets being comprised of a U-shaped metal member having the free ends thereof affixed to a respective one of said post members and forming a vertically oriented cavity therewith.

6. A tank support assembly as specified in claim 5 and further characterized by:

each of said tank support members being a flexible metal strap having each end thereof formed as in a hook, and each of said hooked ends being inserted downwardly into a respective one of said U-shaped members to be held thereby.

7. A tank support assembly as specified in claim 1 and further characterized by:

at least one other hanger bracket being on each of said post members situated directly above a respective one of said first mentioned hanger brackets;

a third support member carried by and between said other hanger brackets on said first and second post members, and a fourth tank support member carried by and between said other hanger brackets on said third and fourth post members; and a second elongated tank carried by said third and fourth tank support members directly above said first mentioned elongated tank.

8. A tank support assemby as specified in claim 7 and further characterized by:

at least a third hanger bracket being on each of said post members situated directly above a respective one of said first mentioned hanger brackets;

a fifth tank support member carried by and between said third hanger brackets on said first and second post members, and a sixth tank support member carried by and between said third hanger brackets on said third and fourth post members; and a third elongated tank carried by said fifth and sixth tank support members directly above said first mentioned tank and said second elongated tank.

* * * * *